US006264571B1

(12) United States Patent
Lekavich

(10) Patent No.: US 6,264,571 B1
(45) Date of Patent: Jul. 24, 2001

(54) DYNAMICALLY BALANCED MODULAR PUTTER WITH A SLIDING HOSEL

(76) Inventor: Carl Lekavich, P.O. Box 910, Lomita, CA (US) 90717

( * ) Notice: Subject to any disclaimer, the term of this patent is extended or adjusted under 35 U.S.C. 154(b) by 0 days.

(21) Appl. No.: 09/305,516

(22) Filed: May 5, 1999

(51) Int. Cl.[7] ..... A63B 53/04; A63B 53/06

(52) U.S. Cl. ..... 473/340; 60/341; 60/313; 60/325

(58) Field of Search ..... 473/305, 307, 473/344, 313, 340, 341, 342, 334, 335, 251, 325

(56) References Cited

U.S. PATENT DOCUMENTS

| | | | | |
|---|---|---|---|---|
| D. 91,336 | | 1/1934 | Thompson . | |
| D. 197,725 | | 3/1964 | Miartuz . | |
| 807,224 | | 12/1905 | Vaile . | |
| 2,820,638 | | 1/1958 | Morrison . | |
| 2,926,913 | | 3/1960 | Stecher . | |
| 4,506,888 | * | 3/1985 | Nardozzi | 273/80.1 |
| 5,078,398 | * | 1/1992 | Reed et al. | 273/80 |
| 5,290,035 | | 3/1994 | Hannon et al. . | |
| 5,292,128 | | 3/1994 | Solheim . | |
| 5,308,067 | | 5/1994 | Cook . | |
| 5,308,068 | | 5/1994 | Strand . | |
| 5,497,992 | | 3/1996 | Ritke . | |
| 5,544,883 | * | 8/1996 | Meyer | 473/313 |
| 5,551,694 | | 9/1996 | Grim, Jr. et al. . | |
| 5,595,547 | | 1/1997 | Lekavich . | |
| 5,716,290 | * | 2/1998 | Baker et al. | 473/313 |
| 5,769,733 | | 6/1998 | Williams et al. . | |

* cited by examiner

*Primary Examiner*—Jeanette Chapman
*Assistant Examiner*—Sneh Varma
(74) *Attorney, Agent, or Firm*—Price and Gess

(57) ABSTRACT

The present invention teaches a dynamically balanced putter with a sliding hosel to ensure that the center of mass of the putter lies on the axis defined by the putter shaft. The putter head includes a longitudinal slot which mates with an elongated "dovetail" tab on the hosel to slidingly position the axis, hosel, and putter head such that the aforementioned balancing objective is achieved. In a preferred embodiment, a dovetailed tab is mated with a mating slot, and the putter head is slid into a position with minor adjustments following an initial balancing, which results in a dynamic balancing of the entire putter. By rotating the putter about the shaft or suspending the shaft and evaluating the angle against vertical, minute adjustments can be made by sliding the putter head along the dovetailed tab until complete balancing is achieved. Once the putter head has been fixed using either a strong adhesive or other fixing means, the putter can then be used in its intended manner.

8 Claims, 2 Drawing Sheets

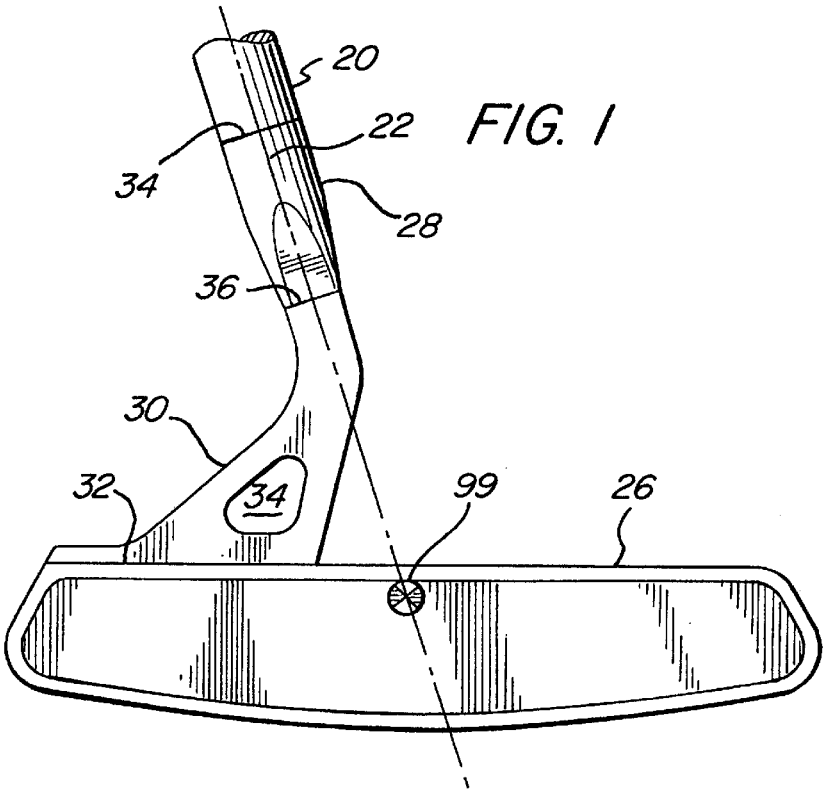
FIG. 1
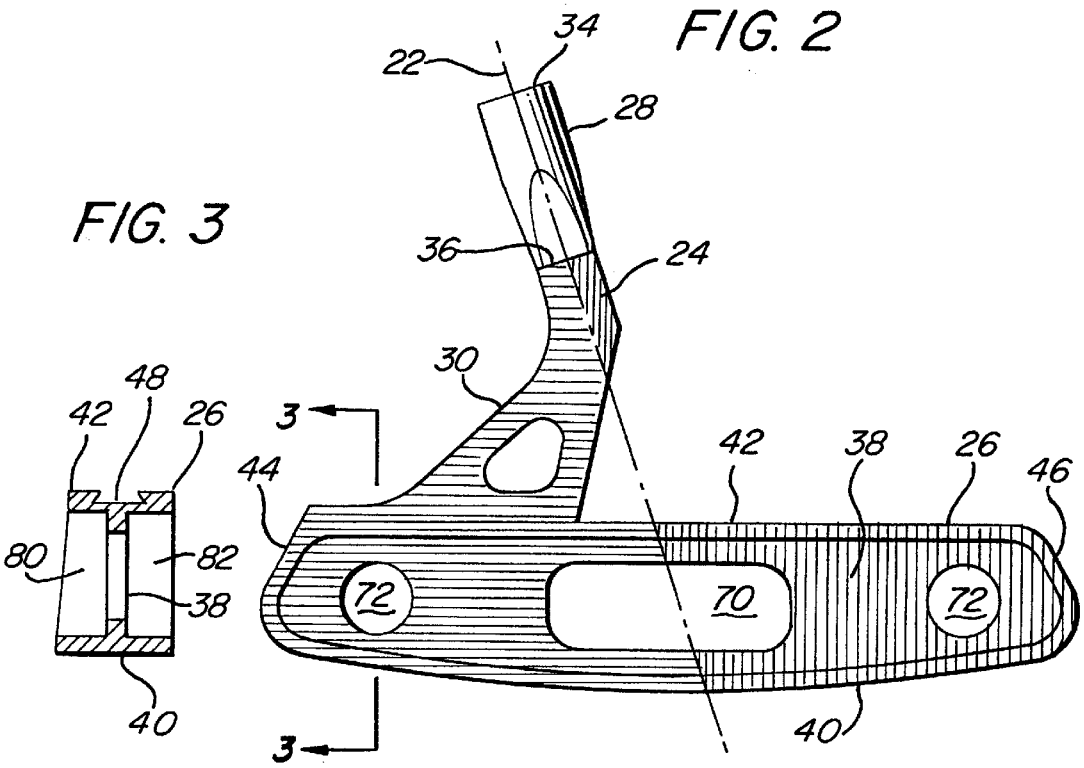
FIG. 2
FIG. 3

DYNAMICALLY BALANCED MODULAR PUTTER WITH A SLIDING HOSEL

BACKGROUND OF THE INVENTION

1. Field of the Invention

The present invention relates generally to golf clubs, and particularly to a dynamically balanced golf club putter with a modular design and a sliding hosel which allows for putter head positioning to ensure that the center of mass of a putter lies on an axis coincident with the axis of the shaft of the putter.

2. Description of Related Art

The game of golf has recently enjoyed a surge in popularity and is enjoyed by people both young and old. An important aspect of the game of golf is the art of putting. Putting involves striking the ball with a club having generally a perpendicular face causing the ball to roll relatively short distances, but with significantly more accuracy than other golf clubs. Just as there is a wide variety of putting techniques, so are there many differing opinions on what characteristics an optimum putter should have. Some putters have very heavy putting heads, whereas others are designed to be very light. Different materials have been used to give the putter a different feel, and putter heads and shafts vary in size, length and shape. While there is no "right" design for a putter, there is a consensus that a putter which is more balanced will usually give the best feel and yield the best accuracy. To balance a putter, the longitudinal axis of the putter shaft coincides or passes through the center of mass of the entire putter, i.e., shaft, hosel and putter head. A putter balanced in this manner, when suspended by the top of the shaft, will cause the shaft to hang directly vertical with respect to the ground because the shaft centerline passes through the center of mass, so there is no imbalance which would cause the shaft to deviate from vertical.

There have been attempts to achieve a balanced putter in the prior art, for example, the teachings of Morrison, U.S. Pat. No. 2,820,638. In Morrison, a center of gravity for the putter head has been determined and the axis of the putter shaft is positioned to pass through the center of gravity of the putter head. While this improves the overall balance of the putter, it does not provide complete balance since the hosel portion of the putter is neglected in the overall balancing. Thus, if one was suspend the putter from the top of the shaft, the shaft would make and angle with vertical which would be greater than zero. Another method to determine putter balance is to spin the putter about the axis of the shaft. An unbalanced putter would wobble due to the net moment attributable to the hosel element, whereas a balanced putter spins without wobble since the center of mass of the entire putter lies on the axis of rotation. Furthermore, as in other prior art putters with the objective of balancing the putter, there is no means for adjusting the position of the putter head and shaft to improve the balance should the putter become imbalanced.

SUMMARY OF THE INVENTION

The present invention teaches a dynamically balanced putter with a modular design and a sliding hosel to ensure that the center of mass of the putter lies on the axis defined by the putter shaft. The putter head includes a longitudinal slot which mates with an elongated tab on the hosel to slidingly position the axis, hosel, and putter head such that the aforementioned balancing objective is achieved. In a preferred embodiment, a dovetailed tab is mated with a complimentary mating slot and the putter head positioned on the hosel. After balancing the putter, the putter head position is adjusted accordingly and fixed to the hosel resulting in a dynamically balanced putter. By rotating the putter about the shaft or suspending the shaft and evaluating the angle against vertical, minute adjustments can be made by sliding the putter head along the dovetailed tab until complete balancing is achieved. Once the putter head has been fixed using either a strong adhesive or other fixing means, the putter can then be used in its intended manner.

BRIEF DESCRIPTION OF THE DRAWINGS

The exact nature of this invention, as well as its objects and advantages, will become readily apparent from consideration of the following specification as illustrated in the accompanying drawings, in which like reference numerals designate like parts throughout the figures thereof, and wherein:

FIG. 1 illustrates a side view of the putter head, hosel and a portion of the shaft;

FIG. 2 is a side view of the putter head hosel and a portion of the shaft with the striking surface cover plates removed;

FIG. 3 is a cross sectional view along section line 3—3 of FIG. 2.

DETAILED DESCRIPTION OF THE PREFERRED EMBODIMENTS

Figure 4:
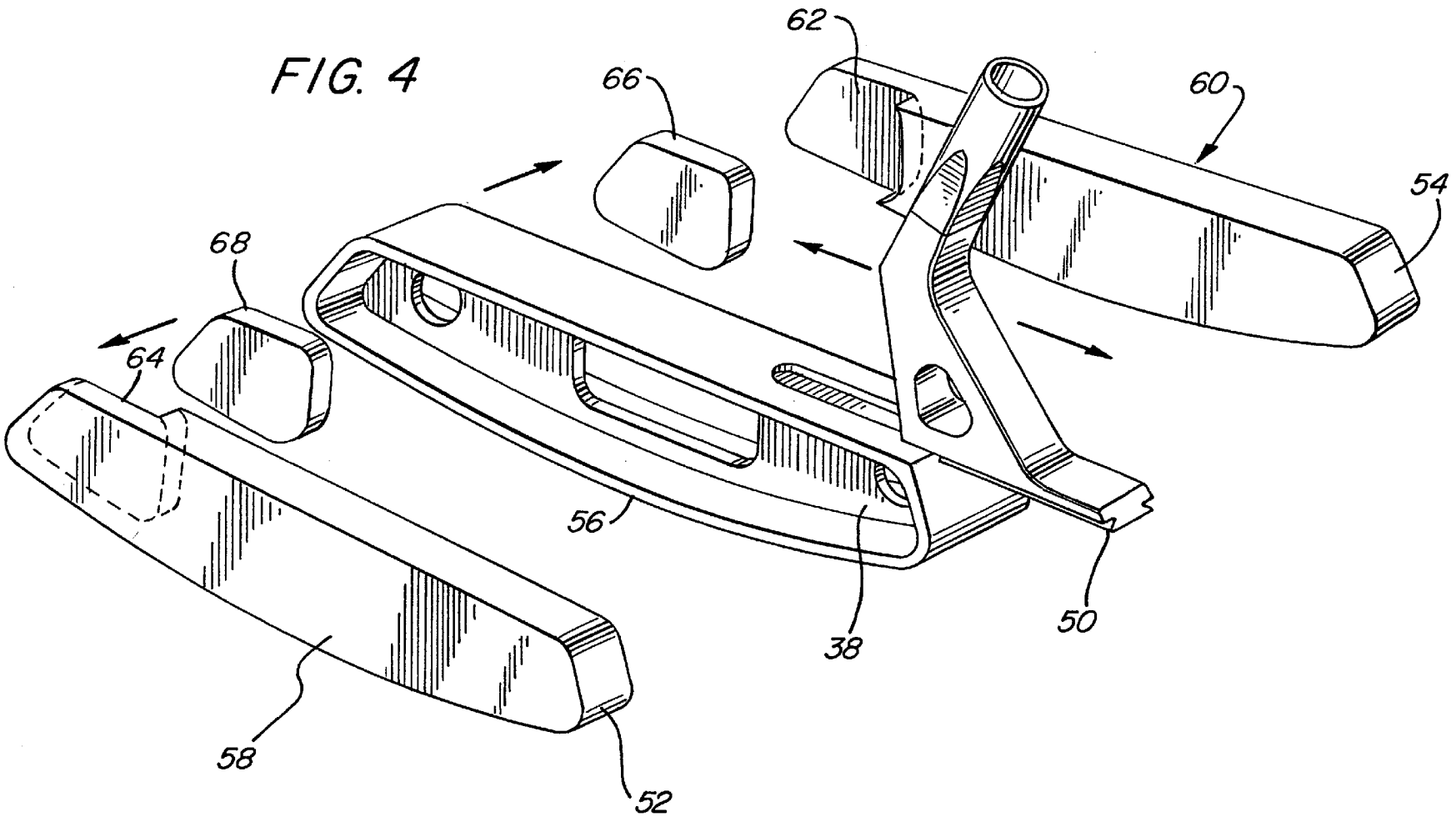
FIG. 4 is an exploded view of a preferred embodiment of the present invention.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a dynamically balanced putter with a modular design and an adjustable sliding hosel.

In FIG. 1 a first preferred embodiment is illustrated with the putter shaft 20 partially removed for clarity. As with conventional putters, the shaft 20 is preferably a material such as steel or graphite, but may be made of any suitable material of sufficient strength and rigidity. For the present invention, the shaft 20 should have a centerline 22 running along its longitudinal axis which is straight and which the shaft 20 is symmetric about that centerline.

In addition to the shaft 20, the putter includes a hosel 24 and a putter head 26. The hosel 24 includes an insertion cap 28 and a triangular body 30 with a flat lower edge 32. In a preferred embodiment, the triangular body 30 further includes an aperture 34 passing through to minimize the weight of the hosel, or can be used to adjust the balancing process. The insertion cap 28 receives the end of the shaft 20 therein and is pressfit or adhesively secured therein. On advantage of the modular design of the present invention is the flexibility of the putter to adjust to different putting preferences. An example of this advantage is in a preferred embodiment of the insertion cap wherein the hole is drilled a degree or so off center. In doing so, by rotating the insertion cap 180° two different lie angles are achieved 2° apart without adding any new parts. By offering several different hoses each with unique lie angles, the desired lie angle can easily and quickly be achieved with the present invention.

The insertion cap 28 may be made of a different material from the triangular body 30, for example, a brass insertion cap has been found to be a suitable material whereas the triangular body may be made of aluminum. The insertion cap 28 is machined such that the first end 34 which receives the shaft 20 has a circular cross section but the connection point 36 to the triangular body 30 has a generally square cross section. Along the lower surface of the triangular body a tab is machined which mates with a slot on the upper surface of the putter head to mate the two components.

The putter head 26 is also machined from a metal, preferably aluminum. As can be seen in FIGS. 2 and 3, the putter head is comprised of an I-beam body with a center plate 38 connected to a curved lower surface 40, a generally flat upper surface 42 and first and second rounded edges 44, 46. Along the top of the upper surface 42 at the end which connects to the hosel, a slot 48 is formed from the edge 44 of the flat upper surface to a middle portion. The slot 48 is sized to receive the tab 50 on the lower surface 32 of the hosel 24 and fix the hosel 24 and the putter head 26 in a sliding relationship.

As seen in FIG. 2, a side view of the putter head and hosel are shown with the contact surface plates cover plates removed. The center plate 38 which forms the middle part of the I-beam is shown with holes 70, 72 formed therein-through. The holes can be used to reduce the weight of the putter head and thus to balance the putter, or to hold inserts which may be used to balance the putter head. Alternatively, the holes 70, 72 can be filled with a shock absorbing material such as a polymer to deaden the impact between the ball and the putter head. In another embodiment, the holes can be filled with a resilient material such as polyurethane or other elastic polymer to increase the energy imparted from the club to the ball.

Centerline 22 passes along the shaft and down through the hosel and through the putter head as shown, separating the hosel into left and right components and similarly separating the putter head into left and right pieces. With a symmetric shaft, the center of mass of the shaft itself will lie somewhere along the centerline or axis of the shaft 22. The center of mass of the hosel 24 alone will clearly lie to the left of the centerline 22 (the left hand component) of the shaft extended to the putter head since the majority of the mass of the hosel is left of the centerline. The center of mass for the putter head alone may initially be either on the left hand component or the right hand component, depending on the initial position of the shaft with respect to the putter head. The objective is for the center mass 99 of the combination of the hosel 24 and the putter head 26 to lie along the axis of the shaft 22. To achieve this, the weight of the left hand component of the hosel plus the weight of the left hand component of the putter head must equal the respective right hand components of each. In this case, the putter when rotated about the shaft will spin without an imbalance and will give a lighter and more solid feel to the putter.

To achieve the dynamic balancing as described above, the hosel 24 and shaft 20 can be slid along the longitudinal slot 48 until the centerline of the shaft 22 passes through the center of mass of the combination of the hosel and the head. By providing an adjustable hosel, minute adjustments can be made to refine the balancing of the club to the point it is completely dynamically balanced.

FIG. 3 illustrates the cross section of the putter head and in particular the dovetail slot 48 including a necked portion on the upper surface of the putter head. The profile of the I-beam body 56 of the putter can be seen from FIG. 3. Two cavities 80, 82, one on either side of the centerplate 38, are filled with a contact surface cover plates 52, 54 which gives the putter head its desired weight, which can vary according to the needs of the user, and also can be used to adjust the balance of the putter head. On the lower surface of the hosel, a mating tab 50 slides into the slot and fixes the hosel and the putter head together in a sliding relationship. Once the hosel 24 is connected to the putter head 26, the putter can be rotated to determine if the putter is out of balance. By making minute adjustments to the position of the hosel with respect to the putter head, a more refined balance can be achieved. In this manner, unlike the prior art putters, a dynamically balanced putter can be achieved.

In a preferred embodiment, as shown in FIG. 4, adjacent to the center plate 38 are first and second contact surface cover plates 52, 54 which add the desired mass to the putter head 26. In a first example, bronze cover plates are machined and sized to fit into the cavity formed by the I-beam body 56 of the putter head in a manner which completely fills the cavity and produces a generally flat contact surface 58, 60 on each side of the I-beam center plate 38. In a preferred embodiment, the contact surface cover plates 52, 54 have a cutout section 62, 64 which allows weighted inserts 66, 68 to be included in the cavity, which can be used to aid in a balancing process. The inserts will preferably be made of lead or other heavy material to adjust the balance of the putter.

If a plurality of hosels are available, each with slightly lie angles, then the user may select from that hosel which provides most comfortable lie angle for his/her particular putting stance. In this manner, the user is not required to adjust to the particular putter, but rather the putter can be adjusted to adapt to the user. Once the particular hosel and lie angle are selected, the slot and tab arrangement allow for dynamic balancing of that particular combination by sliding the hosel incrementally along the longitudinal slot until a dynamic balance is achieved.

Another benefit of the arrangement of the present invention is that a duel-face type putter, i.e., one that can be used by both left and right handed golfers, can be switched to a blade or mallet-type putter very quickly and easily. Due to the modular design of the present invention, by selecting materials to balance along the longitudinal axis of the putter head, a blade-type or mallet-type insert can be switched for the rear contact surface cover plate of the duel-face putter. If the front cover plate on the contact surface and the blade or mallet insert selected for the rear face balance each other then the putter achieves its dynamic balance while providing the user with a choice of blade or mallet type putters.

Those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. A golf club comprising a head, a hosel, and a shaft, and a club center of mass defined by a relative position and mass of said head, hosel, and shaft, the axis of the shaft defining an axis of revolution for dynamically balancing the golf club, and where the relationship between the head, the hosel and the shaft is such that the axis of the shaft passes through the club center of mass, the club head including an I-beam profile defined by a cross section of the putter head from a vertical slice perpendicular to a plane defined by the striking surface of the putter head, the I-beam profile defining first and second cavities on either side of said I-beam profile body, and first and second striking surface cover plates disposed on a front and back of said golf club head enclosing said first and second cavities.

2. The golf club as recited in claim 1 including inserts of a different material than said striking surface cover plates.

3. The golf club as recited in claim 1 wherein said I-beam profile body includes holes filled with an elastic polymer.

4. A golf club comprising a head, a hosel, and a shaft, and a club center of mass defined by a relative position and mass of said head, hosel, and shaft, the axis of the shaft defining an axis of revolution for dynamically balancing the golf club, and where the relationship between the head, the hosel and the shaft is such that the axis of the shaft passes through the club center of mass, wherein said head includes a slot on an upper surface and extending from a middle portion to an end of said head, said slot having a necked portion along said upper surface, and said hosel includes a dovetail member sized to be inserted slidingly into said slot such that said dovetail member is rigidly fixed in said slot save said sliding motion, whereby the relative positions of said hosel and said head are rigidly fixed in said slot at a location where the center of mass intersects the axis of the shaft.

5. The golf club as recited in claim 4 wherein the hosel includes an insertion cap of a material different from a material of said hosel and said shaft, said material of said insertion cap selected to achieve said dynamic balancing.

6. The golf club as recited in claim 5 wherein the insertion cap has an aperture misaligned with said axis of said shaft such that, by rotating said insertion cap, two distinct lie angles of said putter head is achieved.

7. The golf club as recited in claim 4 wherein the hosel is selected from a plurality of hosels each having a different lie angle, and wherein said dynamic balancing is achieved by positioning said selected hosel in said slot at the position which achieves said dynamic balancing.

8. The golf club as recited in claim 4 further comprising a first interchangeable striking surface on a side face of said club, and a mallet club insert on a second face of said club, where said first striking surface and said mallet club insert are weighted to maintain dynamic balance.

* * * * *